US006790325B2

(12) United States Patent
Gates et al.

(10) Patent No.: US 6,790,325 B2
(45) Date of Patent: Sep. 14, 2004

(54) RE-USABLE MANDREL FOR FABRICATION OF INK-JET ORIFICE PLATES

(75) Inventors: Craig M. Gates, Corvallis, OR (US); Niranjan Thirukkovalur, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 160 days.

(21) Appl. No.: 09/829,500

(22) Filed: Apr. 9, 2001

(65) Prior Publication Data

US 2002/0144613 A1 Oct. 10, 2002

(51) Int. Cl.[7] ..... C25D 1/10

(52) U.S. Cl. ..... 204/281; 428/141; 428/336; 428/432; 428/698; 347/20; 347/47

(58) Field of Search ..... 204/281; 29/890.1; 347/20, 47; 428/141, 336, 432, 698, 195

(56) References Cited

U.S. PATENT DOCUMENTS 2,166,367 A * 7/1939 Norris ..... 205/70
3,702,270 A * 11/1972 Meiro et al. ..... 148/105
3,703,450 A * 11/1972 Bakewell ..... 205/75
4,549,939 A * 10/1985 Kenworthy et al. ..... 205/67
4,773,971 A * 9/1988 Lam et al. ..... 205/75
5,255,017 A * 10/1993 Lam ..... 347/47
5,443,713 A 8/1995 Hindman ..... 205/70
5,560,837 A 10/1996 Trueba ..... 216/27
6,586,112 B1 * 7/2003 Te ..... 428/596

* cited by examiner

*Primary Examiner*—Nam Nguyen
*Assistant Examiner*—Brian L. Mutschler

(57) ABSTRACT

A method for creating a mandrel for electroforming orifice sheets with tapered bores is described. The method uses photo-imagable polymer or photoresist to create the desired profile. This is followed by electroforming a parent mandrel over which a mandrel-quality sheet of glass is melted. An array of pillars with defined location and shape is formed with a desired profile for the mandrel to be used for the electroforming process. The glass is then metalized. A photoresist mask is formed on the metalized glass and a dielectric is deposited onto the pillars.

20 Claims, 3 Drawing Sheets

RE-USABLE MANDREL FOR FABRICATION OF INK-JET ORIFICE PLATES

(2) CROSS-REFERENCE TO RELATED APPLICATIONS

None.

(3) STATEMENT REGARDING FEDERALLY SPONSORED RESEARCH OR DEVELOPMENT

None.

(4) REFERENCE TO AN APPENDIX

None.

(5) BACKGROUND OF THE INVENTION

(5.1) Field of the Invention

The present invention relates generally to ink-jet printhead fabrication and, more specifically to making a re-usable mandrel to electroform orifice sheets with a defined, tapered profile.

(5.2) Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy* [*sic*] *Devices*, chapter 13 (Ed. R. C. Durbeck and S. Sherr, Academic Press, San Diego, 1988). Also, many publications describe the details of common techniques used in the fabrication of thin film devices and integrated circuits that can be generally employed in the fabrication of complex, three-dimensional, silicon wafer substrate structures; see e.g., *Silicon Processes*, Vol. 1–3, copyright 1995, Lattice Press, Lattice Semiconductor Corporation (assignee herein), Hillsboro, Oreg. Moreover, the individual steps of such a process can be performed using commercially available fabrication machines. The use of such machines and common fabrication step techniques will be referred to hereinafter as simply: "in a known manner." As specifically helpful to an understanding of the present invention, approximate technical data are disclosed herein based upon current technology; future developments in this art may call for appropriate adjustments as would be apparent to one skilled in the art.

The state of the art is continually developing to improve the quality of the fundamental dot matrix form of printing intrinsic to ink-jet technology. Current products have achieved print densities of 1200 dots-per-inch ("DPI"), achieving print quality comparable to the more expensive laser printers. To that end, thin-film technology has been employed to produce precision components such as orifice plates, fine mesh ink filters, and the like, for ink-jet printheads.

For example, ink-jet pens can utilize an orifice plate generally formed on a thin-film mandrel. The mandrel can consist of a glass plate coated with a conductive film. Non-conductive discs are defined on the surface of the conductive film for determining the location and size of the orifices. Generally, the discs are about three times the diameter of the target hole size. Looking to FIG. 1 (Prior Art), the profile of an electroformed ink-jet nozzle is described by a relationship between the exit bore diameter, $D_{bore}$, the mandrel pad (non-conducting region) diameter, $D_{pad}$, and the thickness, T, of the electroformed sheet:

$$D_{bore}=D_{pad}-2T \qquad \text{Equation 1.}$$

The orifice size is determined by carefully controlling the electroplating parameters (current, timing, and the like) for forming an orifice plate on the mandrel. Therefore, a variation in these parameters will directly affect the size of the orifices. Moreover, if a thicker orifice plate is needed, it is necessary to increase the disc size. Manufacturing tolerances limit such disc dimensioning, resulting in a decreased orifice diameter if the thickness of the orifice plate increases over the disc size tolerance.

One example of an improved METHOD OF MAKING INK-JET COMPONENTS is described in U.S. Pat. No. 5,560,837, Oct. 1, 1996, by Trueba (assigned to the common assignee herein and incorporated herein by reference). Trueba shows a process for fabricating a thin-film structure using a transparent substrate. A first structure, such as a ring having a central pillar, is formed of a conductive material on a surface of the substrate. A photoresist material pillar is formed on top of the conductive material central pillar by exposure through the transparent material.

Generally, state of the art orifice plating mandrel is two-dimensional, meaning that the profile of the orifice assumes a curved shape while the electro-deposited material grows. This is disadvantageous because the ink drop exit bore diameter depends directly on the plating thickness as a function of position. As a result, the bore diameter standard deviation is large across an orifice sheet.

As the state of the art progresses, ink-jet orifice bore diameter tends to decrease. Bore diameter standard deviation for tolerance needs to be reduced. Moreover, bore profiles need to be more accurately engineered so that pen performance can be optimized.

(6) BRIEF SUMMARY OF THE INVENTION

In its basic aspect, the present invention provides a process for fabricating a mandrel including: forming a first structure having a substantially planar electrically conductive surface having a plurality of electrically non-conductive mandrel associated first features affixed distributively across said conductive surface; using said first structure, forming a complementary second structure such that said complementary second structure has a plurality of second features complementary of said first features; and using said second structure, forming the mandrel having third features wherein said third features define shape, location and geometry of features of an electroform created using said mandrel.

In another aspect, the present invention provides a process for fabricating an ink-jet printhead mandrel including: forming a first structure having a substantially planar metalized first surface having a plurality of dielectric first features distributed across said first surface; using said first structure, forming a complementary second structure such that said complementary second structure has a plurality of second features complementary of said first features; and using said second structure, forming the mandrel having third features wherein said third features define shape, location and geometry of features of an inkjet printhead to be electroformed using said mandrel.

In still another aspect, the present invention provides an ink-jet printhead mandrel including: a glass substrate having a plurality of glass-formed mandrel features for electroforming an ink-jet printhead construction hereon; a metal layer superjacent the glass substrate conforming to said features; and a dielectric layer superjacent the metal layer only on and conforming to said features.

The foregoing summary is not intended to be an inclusive list of all the aspects, objects, advantages, and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Objects, features and advantages of the present invention will become apparent upon consideration of the following explanation and the accompanying drawings, in which like reference designations represent like features throughout the drawings.

(7) BRIEF DESCRIPTION OF THE DRAWINGS

Figure 2A:
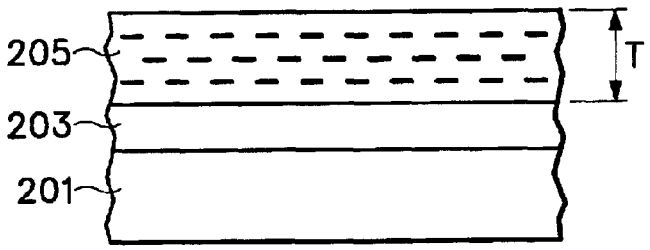
FIGS. 2A through 2F are sequential, schematic, cross-sectional views depicting the process in accordance with the present invention.
Figure 2B:
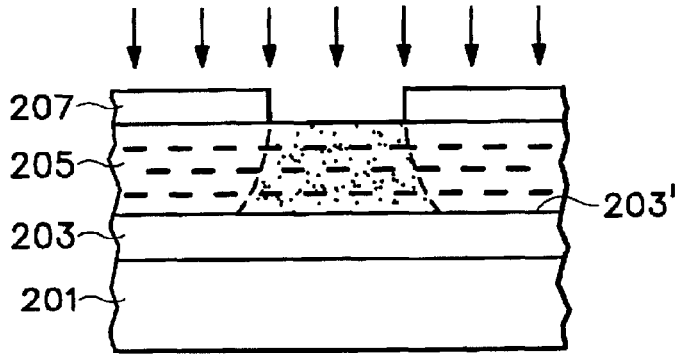
Figure 3A:
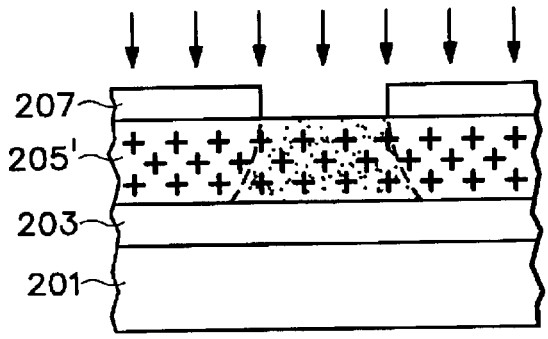
Figure 3B:
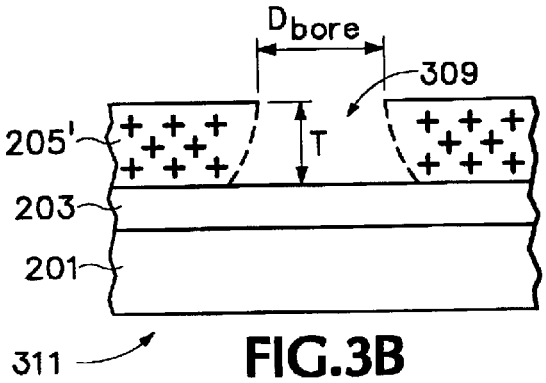

FIGS. 3A and 3B demonstrate an alternative embodiment of steps of the process as shown in FIGS. 2A–2B.

Figure 1:
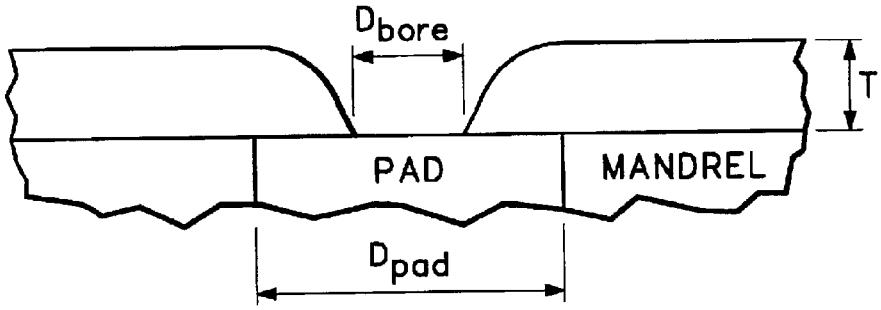
FIG.1 (PRIOR ART)
FIG. 1 (Prior Art) is a schematic depiction of a known manner electroform.
Figure 4:
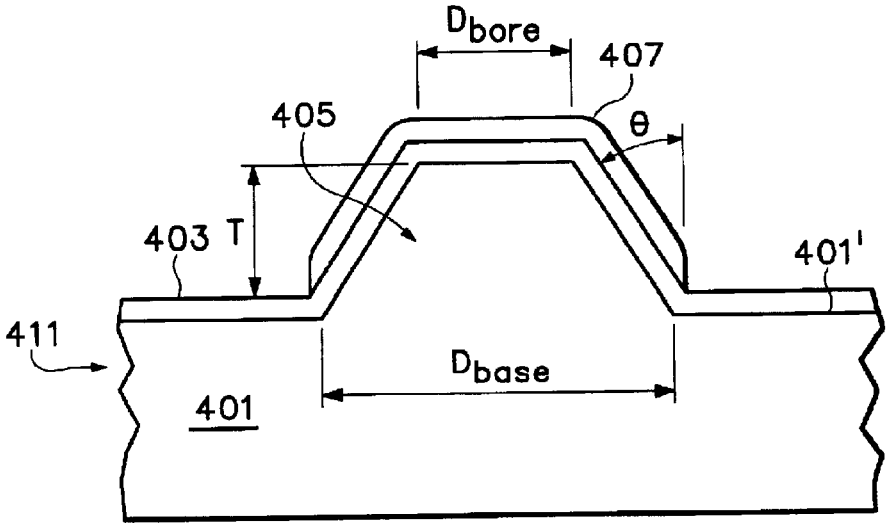

FIG. 4 is a depiction of a mandrel in accordance with the present invention as shown in FIGS. 2A–2F (wherein "$D_{bore}$" corresponds to the diameter of the feature at the thickness of the electroform growing around the feature).

Figure 5:
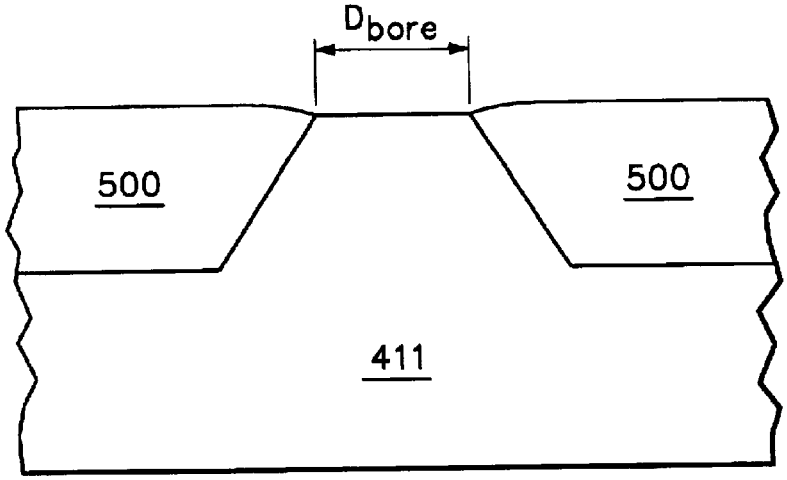

FIG. 5 illustrates the electroforming of the metal nozzle plate sheet 500 using the mandrel as shown in FIG. 4.

The drawings referred to in this specification should be understood as not being drawn to scale except if specifically annotated.

(8) DETAILED DESCRIPTION OF THE INVENTION

Reference is made now in detail to a specific embodiment of the present invention, which illustrates the best mode presently contemplated by the inventors for practicing the invention. Alternative embodiments are also briefly described as applicable. It should be understood that the drawings herein represent one small cross-section of a larger structure having a plurality of the exhibited features. Ink-jet printhead nozzle plates are fabricated in electroformed sheets from which individual nozzle plates are scribed and separated; a typical sheet measures approximately 6 inches-by-6 inches. For example, each nozzle plate may have an array of hundreds of nozzles in columns where the nozzles have an orifice target diameter of 0.0006 inch, separated from each other by 1/300th inch.

Turning now to FIGS. 2A–2F, a method is described for fabricating mandrels with raised features associated ink-jet printhead nozzle plate manufacture in accordance with the present invention. Forming a final raised feature(s) associated is with the ink-jet nozzle plate on a glass substrate is accomplished by making two "parent" mandrels, a "father" mandrel and a "mother" mandrel. The final mandrel used in electroforming nozzle plate sheets will be referred to as the "child" mandrel.

Beginning with the father mandrel process, starting with a planar glass substrate 201 (commercially available from Hoya Corp. USA of San Jose, Calif.), a superjacent metal 203 layer (e.g., preferably stainless steel such as SS316L or a like characteristic metal) is formed via known deposition manner. Note that this step may include incorporating another intermediary layer, such as chromium, so that the stainless steel will have a better adherence. The metal 203 layer has a thickness, "T," in the range of approximately 0.5 to 1.0 $\mu$m. A superjacent photo-imagable polymer 205 is spun in a known manner onto the metal 203 layer. A commercial negative photoresist, such as SU8™ from MicroChem Corp. of Newton, Mass., can be employed; commonly called a "negative resist" as unexposed regions are stripped in subsequent steps. The thickness of the negative resist 205 is controlled through the spinning process and should be at least as thick as the desired thickness of the orifice plate sheet.

Turning to FIG. 2B, the negative resist 205 is masked 207 in accordance with the pattern of features to be formed and exposed to light (generally ultraviolet, UV; represented by descending arrows). The exposed region is depicted with the speckled shading. As is known in photolithography arts, the exposure results are controlled by the thickness, the intensity of the light, and the distance between the mask and photoresist. Thus, the exposure steps can be tailored and optimized to a specific implementation. The photoresist is cured in a known manner.

Figure 2C:
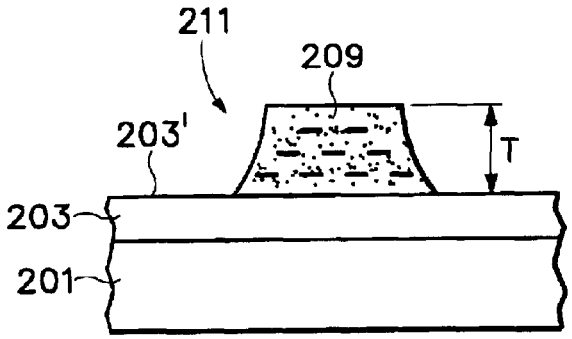
Figure 2D:
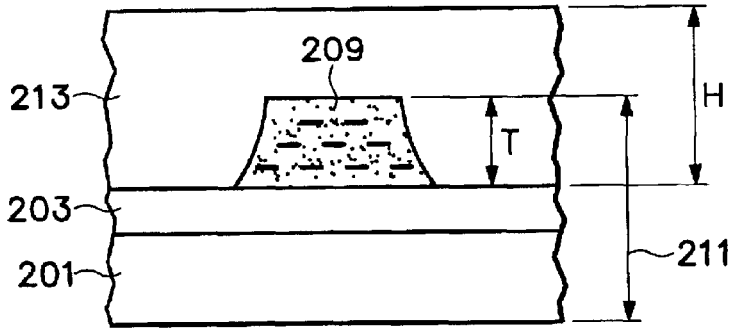

As illustrated by FIG. 2C, the unexposed portions of resist 205 are stripped from the metal 203 layer surface 203', leaving a resultant father mandrel 211: a metalized glass substrate with an array of pillars 209 of cured polymer, the pillars having a defined position and shape, namely the inverse shape of the nozzles to be formed in an orifice plate with the spacing and position defined by the specification of the specific orifice plate(s) to be formed. (Note that a positive resist can be used reversely, viz., with a reversed mask, stripping away the exposed resist to leave the same structure, father mandrel 211 of FIG. 2C.)

Figure 2E:
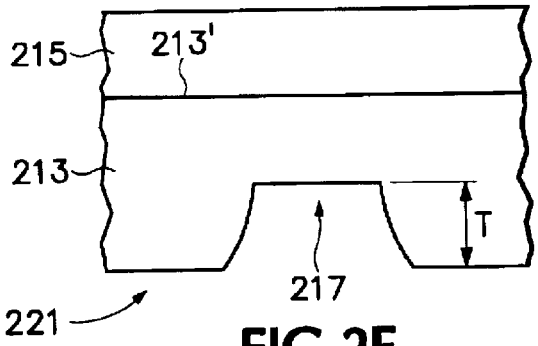

Starting now with the father mandrel 211 of FIG. 2C, the next part of the process is to electroform the mother mandrel. Illustrated by FIG. 2D, the mother mandrel made by electroforming a metal (e.g., nickel) sheet 213 over the father mandrel 211 to a height "H" that is greater than the thickness of the pillar(s) 209 protruding above the father mandrel surface 203'; i.e., H>T. The electroformed metal sheet 213 is removed from the father mandrel 211. Note that the photoresist pillar(s) 209 have formed complementary depression 217 features as shown in FIG. 2E. The electroformed metal sheet 213 can be then mounted to a substrate 215 for added strength and rigidity.

Figure 2F:
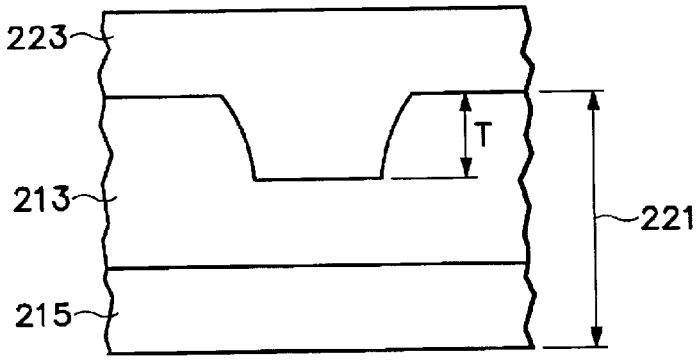

The next part of the process is to make the child mandrel which is ultimately used for fabricating the target inkjet orifice plates. Turning to FIG. 2F, starting with the mother mandrel 221, a superjacent layer of glass 223 is formed by melting glass over the mother mandrel. The glass will flow into the depression 217 features of the mother mandrel 221. Note, using a vacuum oven to heat the glass-mother mandrel sandwich to a liquify the glass is advantageous as it removes gasses from the depression(s) 217, minimizing any pitting (air bubbles) in the flowed glass. Alternatively, melting glass beads that pour into the depression 217 features may also be employed to this advantage. Next, mother and child are separated; the taper of the depression 217 features and the low adhesion of nickel to glass facilitates the separation of the backed metal 213 mother mandrel 221 from the all glass child mandrel piece 223.

Turning to FIG. 4, it can now be recognized that a solid glass child mandrel 401 piece has been formed. The top surface 401' is metalized, preferably with stainless steel in a known manner as with metal 203, FIG. 2A et seq., to a thickness in the approximate range of 0.5 to 1.0 forming a superjacent metal 403 conformed to the shape and dimensions of the solid glass child mandrel 401 piece's top surface 401' features. Again, using a photoresist masking process, child mandrel pillar(s) 405 are rendered non-conducting by depositing a dielectric 407, preferably silicon carbide, "SIC," to a thickness in the approximate range of 3500 to 4000 Å. The child mandrel 411 is completed, ready for use in electroforming orifice plate sheets for ink-jet printheads. Thus, FIG. 4 shows a child mandrel 411 in accordance with the present invention having physical features 405 to control ink-jet nozzle bore profile. Each physical feature has the inverse shape of the desired bore geometry. For example, the feature(s) 405 can have a circular base with a truncated conical shape having a taper angle $\ominus$. The relationship between the electroform thickness, base diameter, and nozzle exit bore is now in accordance with the equation:

$$D_{Bore}=D_{Base}-2\ \mathrm{Tan}\ \ominus \qquad \text{Equation 2.}$$

FIG. 5 illustrates the electroforming of the metal nozzle plate sheet 500 using the child mandrel 411. Because of the structure of the child mandrel 411 fabricated in accordance with the present invention, the mandrel is reusable, providing significantly better control over the shape, dimensions, and relative spacing of the nozzles.

An alternative embodiment for forming a father mandrel is illustrated in FIGS. 3A–3B. In effect, it is an inverse process to FIGS. 2A–2C. As depicted by FIG. 3A, a positive photoresist 205' is exposed in FIG. 3B, the exposed resist is stripped leaving a mother mandrel 311 having a resist 205' having an array of "pot holes"309 associated with the nozzle(s) shape and dimension, again represented as "$D_{Bore}$." (Note here that a negative resist can be used reversely, viz, with a reversed mask, stripping away the unexposed resist to leave the same structure. However, this embodiment is more difficult to use in forming the mother mandrel, primarily because it is difficult to remove the exposed resist in the recess of an acute angle of a feature having a small size.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . " and no process step herein is to be construed under those provisions unless the step or steps are expressly recited using the phrase "comprising the step(s) of . . . "

What is claimed is:

1. A mandrel for forming an inkjet printhead nozzle plate, comprising:

a glass substrate having a top surface with a plurality of glass-formed raised features extending above said top surface and spaced apart from each other, said glass-formed raised features including pillars having a top and side walls;

a metal layer having a first portion formed above said top surface and a second portion formed above said raised features with said first portion connected with said second portion; and a dielectric layer formed above said second portion of said metal layer and covering said top and side walls of said pillars.

2. The mandrel of claim 1 wherein said first portion of said metal layer is integral with said second portion of said metal layer.

3. The mandrel of claim 1 wherein said first portion and said second portion of said metal layer conform to the shape of said glass substrate.

4. The mandrel of claim 3 wherein said first portion and said second portion of said metal layer are directly adjacent to said glass substrate.

5. The mandrel of claim 1 wherein said dielectric layer conforms to the glass-formed raised features.

6. The mandrel of claim 3 wherein said dielectric layer is directly adjacent to said second portion of said metal layer.

7. The mandrel of claim 1 wherein said second portion of said metal layer covers said top and side walls of said pillars.

8. The mandrel of claim 1 wherein said dielectric layer comprises silicon carbide.

9. The mandrel of claim 1 wherein said dielectric layer has a thickness in the approximate range of 3500 to 4000 angstroms.

10. The mandrel of claim 1 wherein said metal layer has a thickness in the approximate range of 0.5 to 1.0 microns.

11. The mandrel of claim 1 wherein said pillars include a base with a base diameter greater than a top diameter.

12. The mandrel of claim 1 wherein said raised features correspond to a shape and position of respective nozzle features electroformed on said mandrel.

13. The mandrel of claim 12 wherein said raised features are tapered to correspond to a shape and position of respective nozzle features electroformed on said mandrel, said nozzle features have an exit bore nozzle diameter smaller than a base nozzle diameter.

14. A mandrel for electroforming an injet printhead nozzle plate, comprising:

a glass substrate having a top surface with a plurality of glass-formed raised pillars extending above said top surface and spaced apart from each other, said pillars each having a top and side walls;

a metal layer having a first portion formed above said top surface and a second portion formed above said raised pillars, with said first portion integral with said second portion; and a dielectric layer formed above said second portion of said metal layer and covering said top and side walls of said raised pillars.

15. The mandrel of claim 14 wherein said metal layer is adjacent to said glass substrate, and said dielectric layer is adjacent to said second portion of said metal layer.

16. The mandrel of claim 14 wherein said side walls of said raised pillars are tapered from a smaller diameter top to a larger diameter base.

17. The mandrel of claim 14 wherein said raised pillars correspond to a shape and position of respective nozzle features electroformed on said mandrel and where said mandrel is re-usable.

18. The mandrel of claim 14 wherein said dielectric layer comprises silicon carbide.

19. The mandrel of claim 14 wherein said dielectric layer has a thickness in the approximate range of 3500 to 4000 angstroms.

20. The mandrel of claim 14 wherein said metal layer has a thickness in the approximate range of 0.5 to 1.0 microns.

* * * * *